US006755468B1

(12) United States Patent
Pan

(10) Patent No.: US 6,755,468 B1
(45) Date of Patent: Jun. 29, 2004

(54) FOLDING CHAIR

(75) Inventor: Toung-Chun Pan, Tainan (TW)

(73) Assignee: Oasyschair Co., Ltd., Tainan Hsien (TW)

( * ) Notice: Subject to any disclaimer, the term of this patent is extended or adjusted under 35 U.S.C. 154(b) by 0 days.

(21) Appl. No.: 10/434,730

(22) Filed: May 9, 2003

(51) Int. Cl.[7] ..... A47C 1/02; A47C 3/04

(52) U.S. Cl. ..... 297/335; 297/331; 297/333; 297/312; 297/239

(58) Field of Search ..... 297/335, 331, 297/333, 332, 239, 312, 302.1

(56) References Cited

U.S. PATENT DOCUMENTS 1,152,480 A * 9/1915 Bouk ..... 297/332
1,176,296 A * 3/1916 Kinner et al. ..... 297/332
2,164,116 A * 6/1939 Lincoln ..... 297/332
3,708,202 A * 1/1973 Barecki et al. ..... 297/239
3,770,235 A * 11/1973 Klapproth et al. ..... 248/634
3,982,785 A * 9/1976 Ambasz ..... 297/160
4,852,943 A * 8/1989 Roper ..... 297/303.1
5,288,127 A * 2/1994 Berg et al. ..... 297/312
6,481,789 B1 * 11/2002 Ambasz ..... 297/55
2003/0090137 A1 * 5/2003 Piretti ..... 297/335
2003/0205923 A1 * 11/2003 Haney et al. ..... 297/335

* cited by examiner

*Primary Examiner*—Peter M. Cuomo
*Assistant Examiner*—Sarah C. Burnham
(74) *Attorney, Agent, or Firm*—Alan D. Kamrath; Nikolai & Mersereau, P.A.

(57) ABSTRACT

A folding chair includes two pairs of intersected legs. A traverse pivot rail interconnects the intersections of the two pairs of legs. Two support mechanisms are spaced along the pivot rail, each support mechanism comprising an upper hole. Two cylinder pads are anchored in the upper holes. Two fastening mechanisms each include an upper section and a lower section, each section having a half tube mating and coupled to each other with the pivot rail passed therethrough. A seat is pivotably secured to the pivot rail by fasteners threaded through the upper and the lower sections and into the seat. In a use position, the seat is adapted to exhibit an elastic, downward movement as buffered by the cylinder pads. In a folding operation, the seat is turned about the pivot rail until being stopped by a chair back.

4 Claims, 6 Drawing Sheets

FOLDING CHAIR

BACKGROUND OF THE INVENTION

1. Field of the Invention

The present invention relates to chairs and more particularly to a folding chair with improved characteristics.

2. Description of Related Art

Various folding chairs have been commercially available. A foldable device or the like, as self-explanatory, is intended to reduce space in a storage position. However, most prior folding chairs suffered from one or more of the following drawbacks such as being: relative complex in construction, bulky, costly to manufacture, trouble-prone, unreliable in use, and visually unattractive. Thus, the present invention provides a novel folding chair in order to overcome the above drawbacks of the prior art.

SUMMARY OF THE INVENTION

It is an object of the present invention to provide a folding chair comprising two pairs of legs, the legs of each pair being intersected; a transverse pivot rail interconnecting the intersections; two support mechanisms spaced along the pivot rail, each support mechanism being shaped as a loop and comprising an upper hole; two cylinder pads anchored in the upper holes; two fastening mechanisms each comprising an upper section having a first half tube and a lower section having a mating second half tube coupled to the first half tube with the pivot rail passed therethrough; and a seat pivotably secured to the pivot rail by driving a plurality of fasteners through the upper and the lower sections into the seat. In a use position, the seat is adapted to exhibit an elastic, downward movement as buffered by the cylinder pads. In a folding operation, the seat is turned clockwise about the pivot rail until being stopped by a chair back.

In one aspect of the present invention, the cylinder pad is formed of elastomeric material.

In another aspect of the present invention, the cylinder pad is formed of rubber.

In a further aspect of the present invention, the cylinder pad has a tapered top end.

The above and other objects, features and advantages of the present invention will become apparent from the following detailed description taken with the accompanying drawings.

DETAILED DESCRIPTION OF THE PREFERRED EMBODIMENTS

Figure 1:
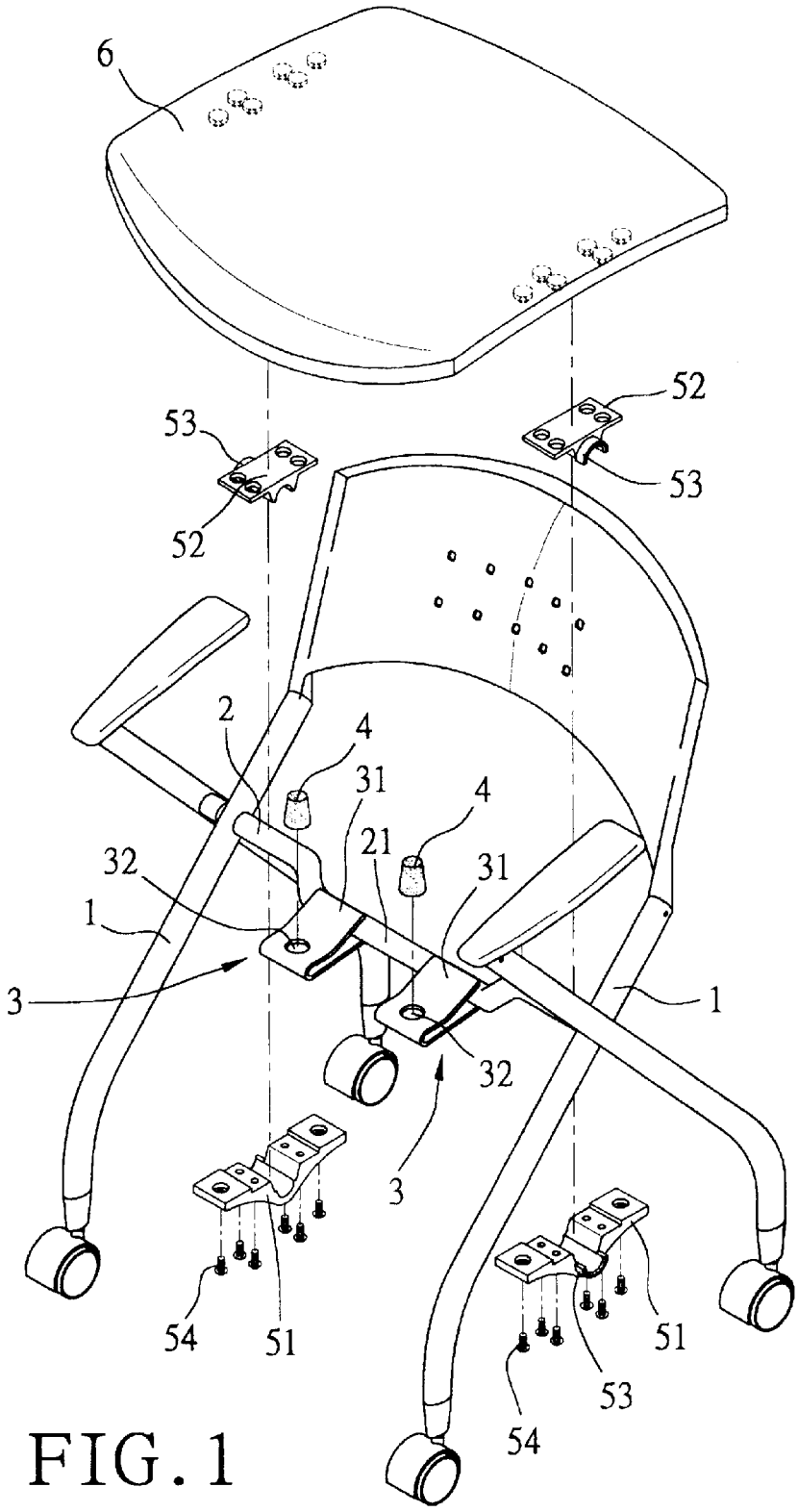
FIG. 1 is an exploded perspective view of a preferred embodiment of a folding chair according to the invention.
Figure 2:
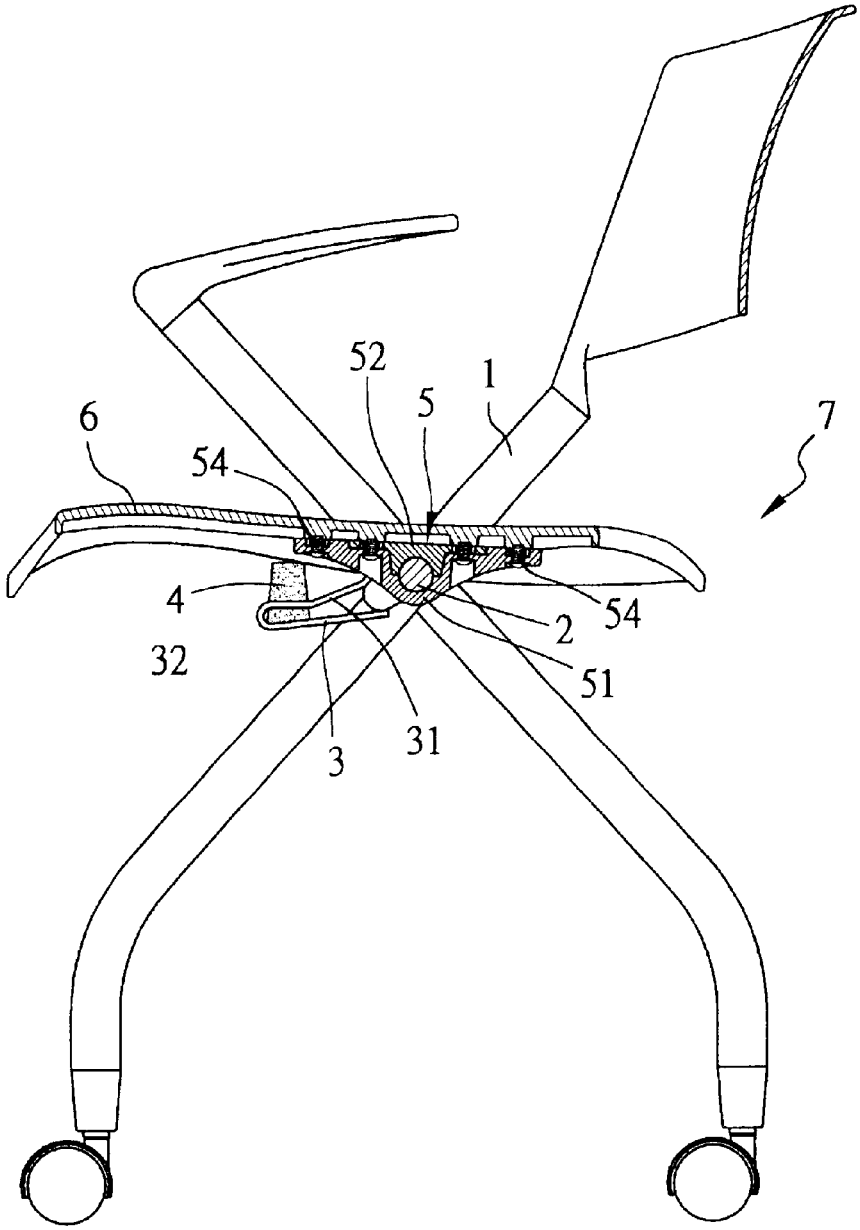
FIG. 2 is a side plan view in part section of the assembled chair shown in FIG. 1.
Figure 3:
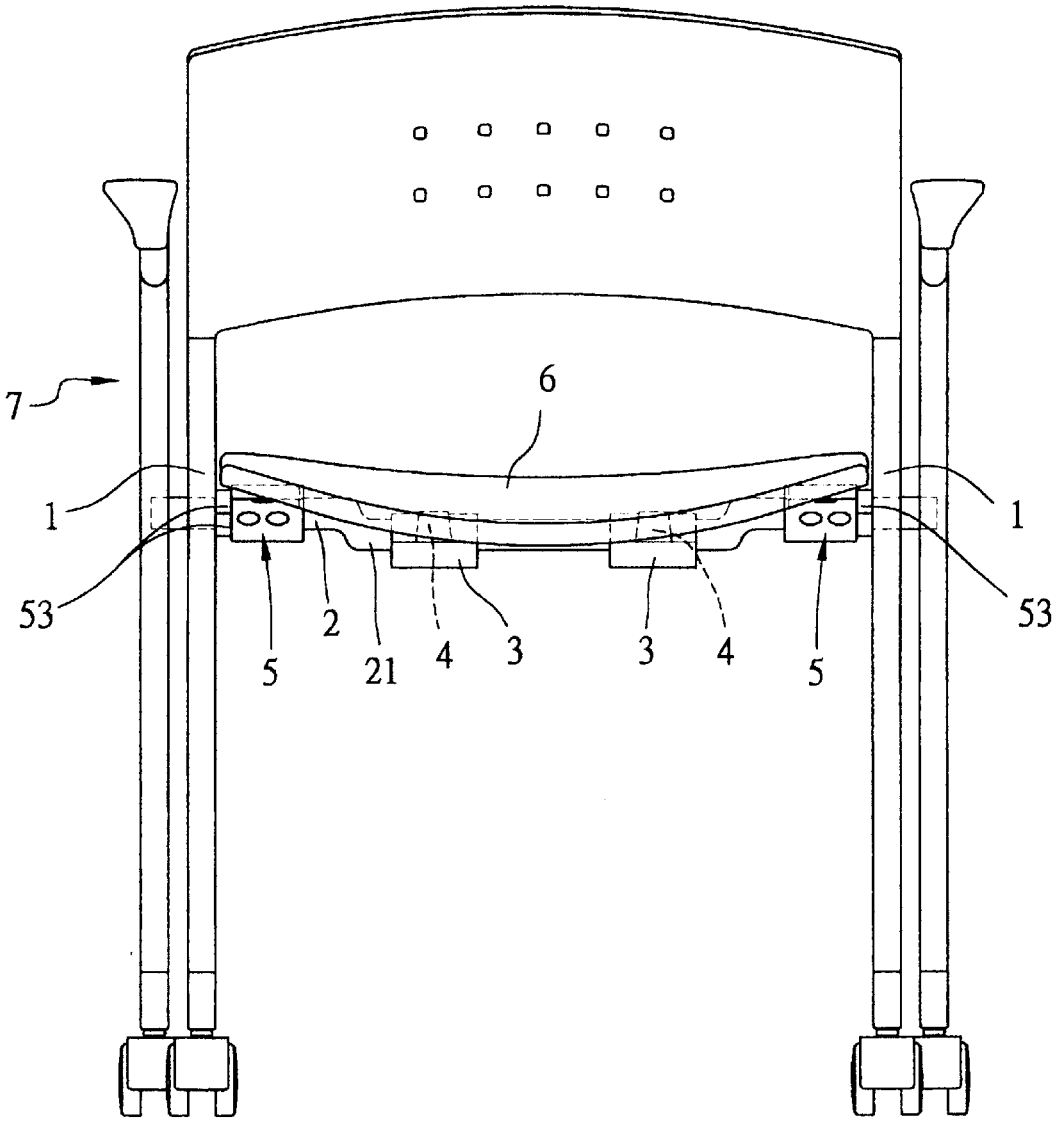
FIG. 3 is a front plan view of the chair shown in FIG. 2.

Referring to FIGS. 1, 2, and 3, a folding chair 7 constructed in accordance with the invention is shown. The chair 7 comprises two pairs of legs 1, the legs 1 of each pair being intersected. A transverse pivot rail 2 has a central section 21 and interconnects the intersections of each pair of legs 1. Two support mechanisms 3 are spaced along the pivot rail 2, each support mechanism 3 being shaped as a flat loop 31 and comprising an upper hole 32. Two cylinder pads 4 are anchored in the upper holes 32, the cylinder pads 4 being formed of elastomeric material, rubber, or the like. The cylinder pads 4 have a tapered top end. Two fastening mechanisms 5 are provided each comprising an upper section 52 and a lower section 51, each section having a half tube 53 matching and coupled to each other with the pivot rail 2 passed therethrough. A seat 6 is pivotably secured to the pivot rail 2 by a plurality of fasteners (e.g., screws) 54 threaded through the upper section 52 and the lower section 51 and into the seat 6.

Figure 4:
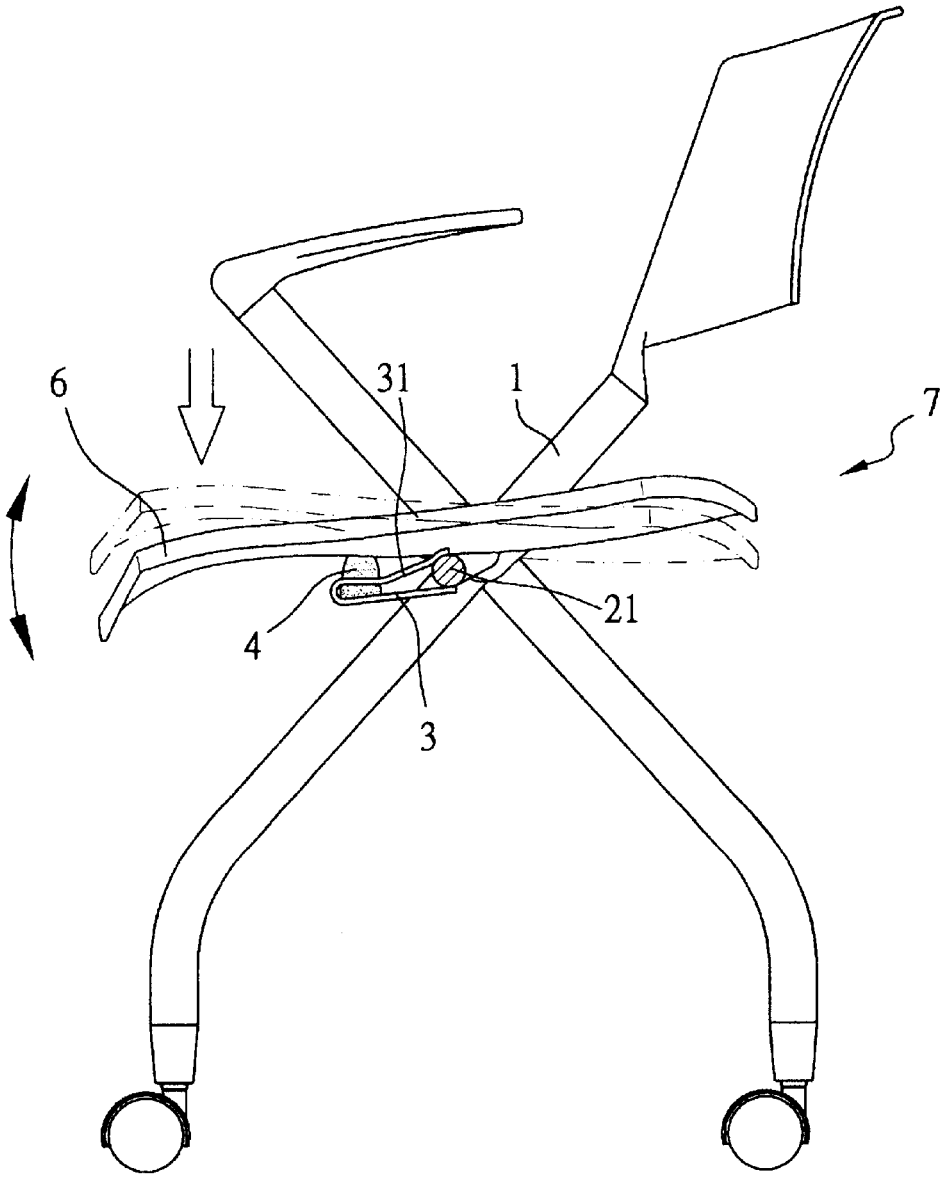
FIG. 4 is a side plan view of the chair for depicting an elastic, up-and-down movement of the chair seat in a slight extent.

Referring to FIG. 4, the seat 6 is adapted to exhibit an elastic, downward movement in a slight extent as buffered by the cylinder pads 4 on the support mechanisms 3 when a person sits on the seat 6. This can bring a degree of comfort to the person while seated.

Figure 5:
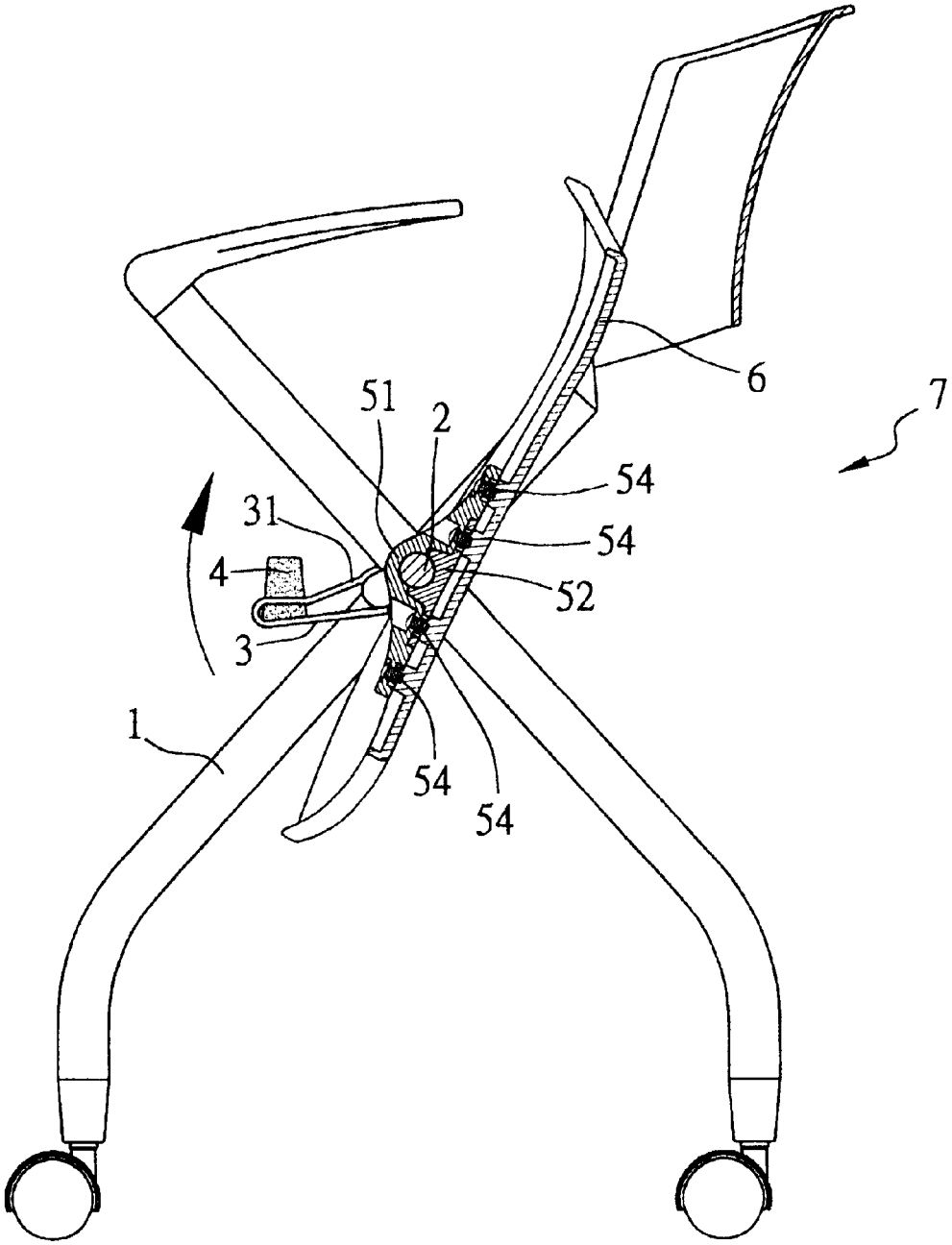
FIG. 5 is a view similar to FIG. 2, the chair being shown during folding.

Referring to FIG. 5, a folding process of the chair 7 will now be described. In a simple manner, a person can turn the seat 6 clockwise about the pivot rail 2 until being stopped by the chair back.

Figure 6:
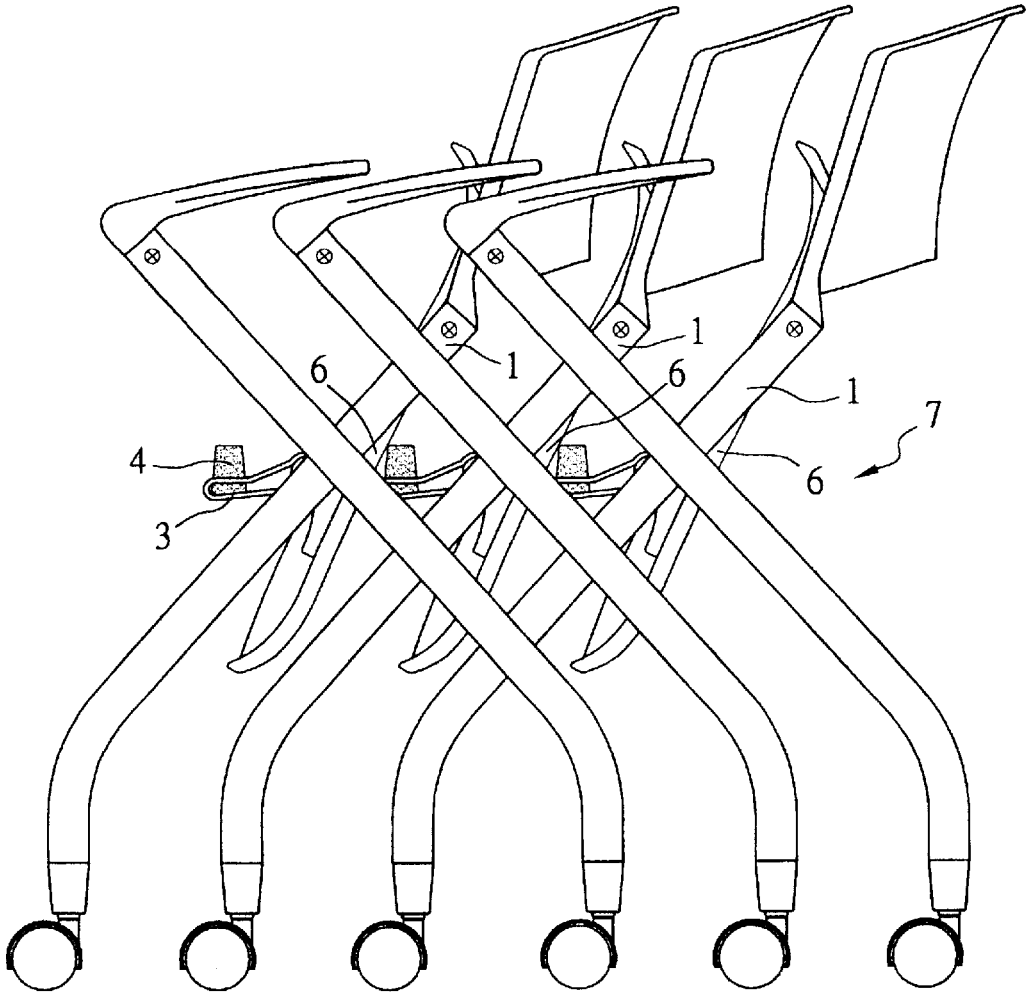
FIG. 6 is a side view illustrating a plurality of folded chairs of the invention arranged side-by-side on a supporting surface.

Referring to FIG. 6, there is shown a plurality of folded chairs 7 of the invention arranged side-by-side on a supporting surface. It is seen that considerable space is saved in a storage position.

While the invention herein disclosed has been described by means of specific embodiments, numerous modifications and variations could be made thereto by those skilled in the art without departing from the scope and spirit of the invention set forth in the claims.

What is claimed is:

1. A folding chair, comprising:

two pairs of legs, the legs of each pair intersecting at an intersection;

a transverse pivot rail interconnecting the intersections of the two pairs of legs;

two support mechanisms spaced along the pivot rail, each support mechanism immovably fixed to the pivot rail and being shaped as a loop and comprising an upper hole;

two cylinder pads anchored in the upper holes;

two fastening mechanisms each comprising upper and lower sections, each section having a half tube mating and coupled to each other with the pivot rail passed therethrough; and a seat pivotably secured to the pivot rail by a plurality of fasteners threaded through the upper and the lower sections and into the seats, with the seat being pivotable relative to the two support mechanisms and the two cylinder pads, wherein in a use position, the seat is adapted to exhibit an elastic, downward movement as buffered by the cylinder pads; and in a folding operation, the seat is turned about the pivot rail until being stopped.

2. The folding chair of claim 1, wherein the cylinder pad is formed of elastomeric material.

3. The folding chair of claim 1, wherein the cylinder pad is formed of rubber.

4. The folding chair of claim 1, wherein the cylinder pad has a tapered top end.

* * * * *